US005233749A

United States Patent [19]

Saito et al.

[11] Patent Number: 5,233,749

[45] Date of Patent: Aug. 10, 1993

[54] HYDRAULIC ACTUATOR

[75] Inventors: Masayuki Saito; Masunari Kowada, both of Tokyo, Japan

[73] Assignee: Nitto Kohki Co., Ltd., Tokyo, Japan

[21] Appl. No.: 872,999

[22] Filed: Apr. 24, 1992

[30] Foreign Application Priority Data

May 15, 1991 [JP] Japan ..... 3-43701[U]

[51] Int. Cl.[5] ..... B26F 1/00; B26F 3/02; B26B 15/00; B26D 5/12

[52] U.S. Cl. ..... 30/362; 30/358; 30/228; 83/639.1

[58] Field of Search ..... 30/228, 277, 277.4, 30/358, 362; 83/639.1; 63/639.1

[56] References Cited

U.S. PATENT DOCUMENTS 3,626,445 12/1971 Penix ..... 30/228
3,693,254 9/1972 Salonen ..... 30/228
3,924,330 12/1975 Mitsuhashi et al. ..... 30/358
4,022,096 5/1977 Forichon ..... 83/639.1
4,088,048 5/1978 Olsson ..... 30/358
4,825,755 5/1989 Takano ..... 83/639.1
4,998,351 3/1991 Hartmeister ..... 30/228

FOREIGN PATENT DOCUMENTS 55-18568 4/1980 Japan .
58-224029 12/1983 Japan .

*Primary Examiner*—Frank T. Yost
*Assistant Examiner*—Paul M. Heyrana
*Attorney, Agent, or Firm*—Nixon & Vanderhye

[57] ABSTRACT

A hydraulic puncher comprises a cylindrical casing, a pump unit including a pump and fixedly held in the casing, a cylinder chamber defined by the cylindrical inner face and the inner end face of the pump unit, a piston reciprocatingly and slidably provided in the cylinder chamber and an oil reservoir which is formed adjacent to the pump unit in the casing and from which the pump sucks operating oil filled within the cylindrical casing.

9 Claims, 3 Drawing Sheets

HYDRAULIC ACTUATOR

BACKGROUND OF THE INVENTION

1. Field of the Invention

This invention relates to a hydraulic actuator for shearing, drilling, bending or caulking a metallic workpiece or performing similar work on a metallic workpiece.

2. Description of the Related Art

As disclosed in Japanese Unexamined Patent Application Publication No. 58-224029, laid open on Dec. 26, 1983, there is proposed a portable and handy hydraulic actuator which comprises a pump block including pumps, and a piston having the front end fixed by a tool selected according to the work to be performed by the hydraulic actuator and operated by supplying operating oil by means of the pump. The pump block is a central member and a tool arm has a rear face which defines, together with the inner peripheral wall of the central member and the inner face of the pump block, a cylinder chamber in which the piston reciprocates. The tool arm is connected at a flange formed on its rear end to the central member at its front end by means of a number of bolts.

In this prior art hydraulic actuator, the number of bolts which connect the flange to the front end of the central member must be increased in order to withstand high pressure. This structure lowers the productivity of the hydraulic actuator due to the corresponding increase in manufacturing and assembling costs. When the bolts are tightened with uneven tightening torques or some bolts are not tightened well, the hydraulic actuator is likely to break under high pressure. For safe operation of the hydraulic actuator under high pressure, it is desired to provide a relief valve for returning operating oil to an oil reservoir when the pressure of the operating oil produced by the pump exceeds an allowable value, and an oil return valve for reducing the pressure exerted on the piston by rapidly returning the operating oil to the oil reservoir after the forward movement of the piston has started. However, the prior art hydraulic actuator having a thick flange through which a number of bolts are inserted does not have ample space for admitting these valves.

SUMMARY OF THE INVENTION

The object of this invention is to provide a hydraulic actuator which does not require bolts for assembling the actuator itself and has high-pressure tolerance and a safe structure.

In order to achieve this object, there is provided a hydraulic actuator comprising a casing having an inner peripheral wall, a pump unit fixedly fitted in the casing and having an inner end face, a cylinder chamber defined by the inner peripheral wall of the casing and the inner end face of the pump unit, a reciprocating piston assembly slidably provided in the cylinder chamber and having an end provided with a tool, and an oil reservoir filled with operating oil and provided adjacent to said pump unit. The pump unit sucks in the operating oil from the oil reservoir and supplies the operating oil to the cylinder chamber.

An oil return passage for returning operating oil from the cylinder chamber to the oil reservoir is formed in the cylinder, and is normally closed by a valve, on one hand, for causing the oil return passage to communicate with the cylinder chamber when the pressure in the cylinder chamber exceeds a predetermined pressure, and on the other hand, for forcibly causing the oil return passage to communicate with the cylinder chamber by moving an operating lever fixed to the valve.

BRIEF DESCRIPTION OF THE DRAWINGS

This invention can be fully understood from the following detailed description with reference to the accompanying drawings in which.

DETAILED DESCRIPTION OF THE PREFERRED EMBODIMENT

Figure 1:
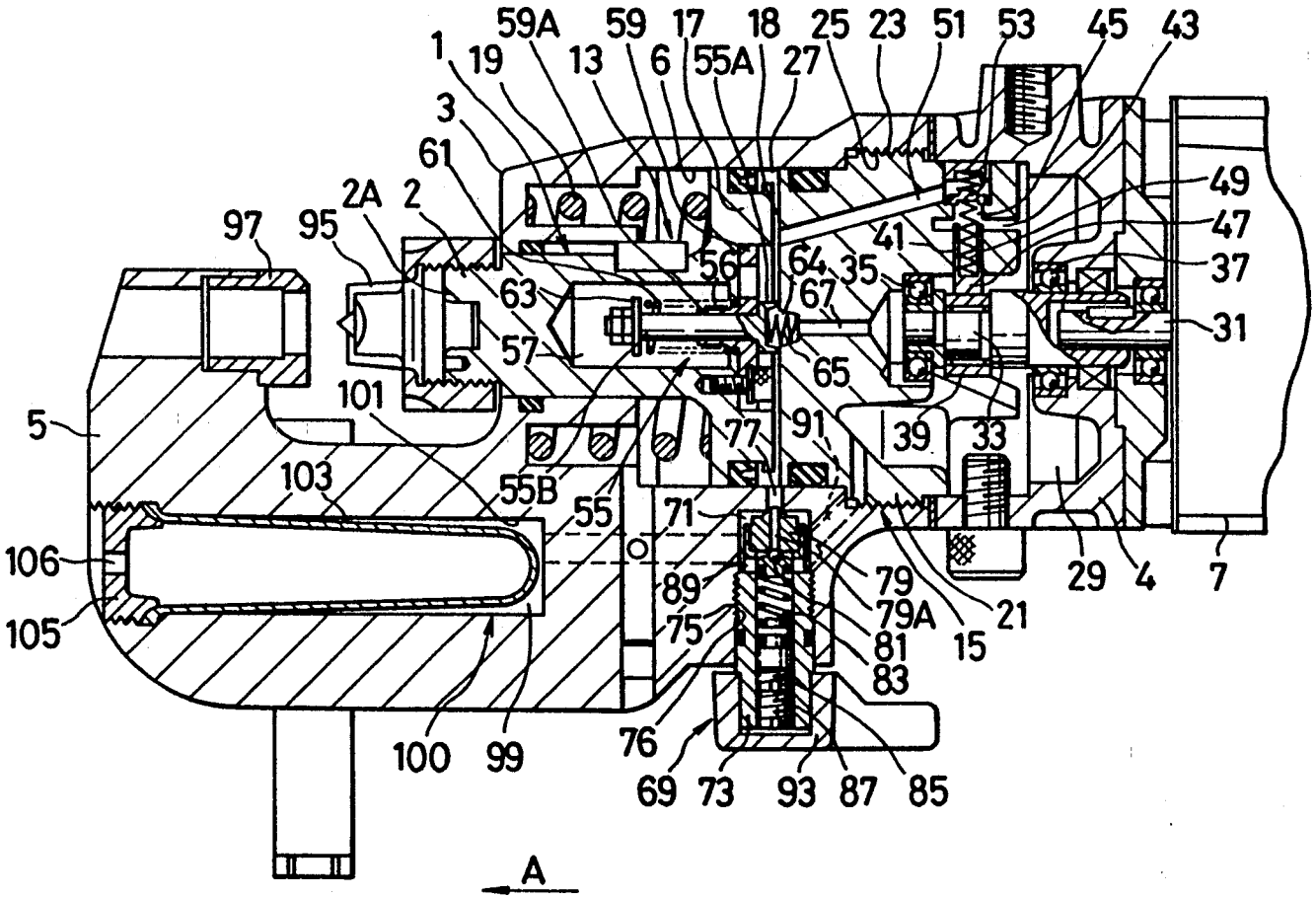
FIG. 1 is a longitudinal cross-sectional view of a hydraulic puncher as an embodiment of the hydraulic actuator according to this invention.
Figure 2:
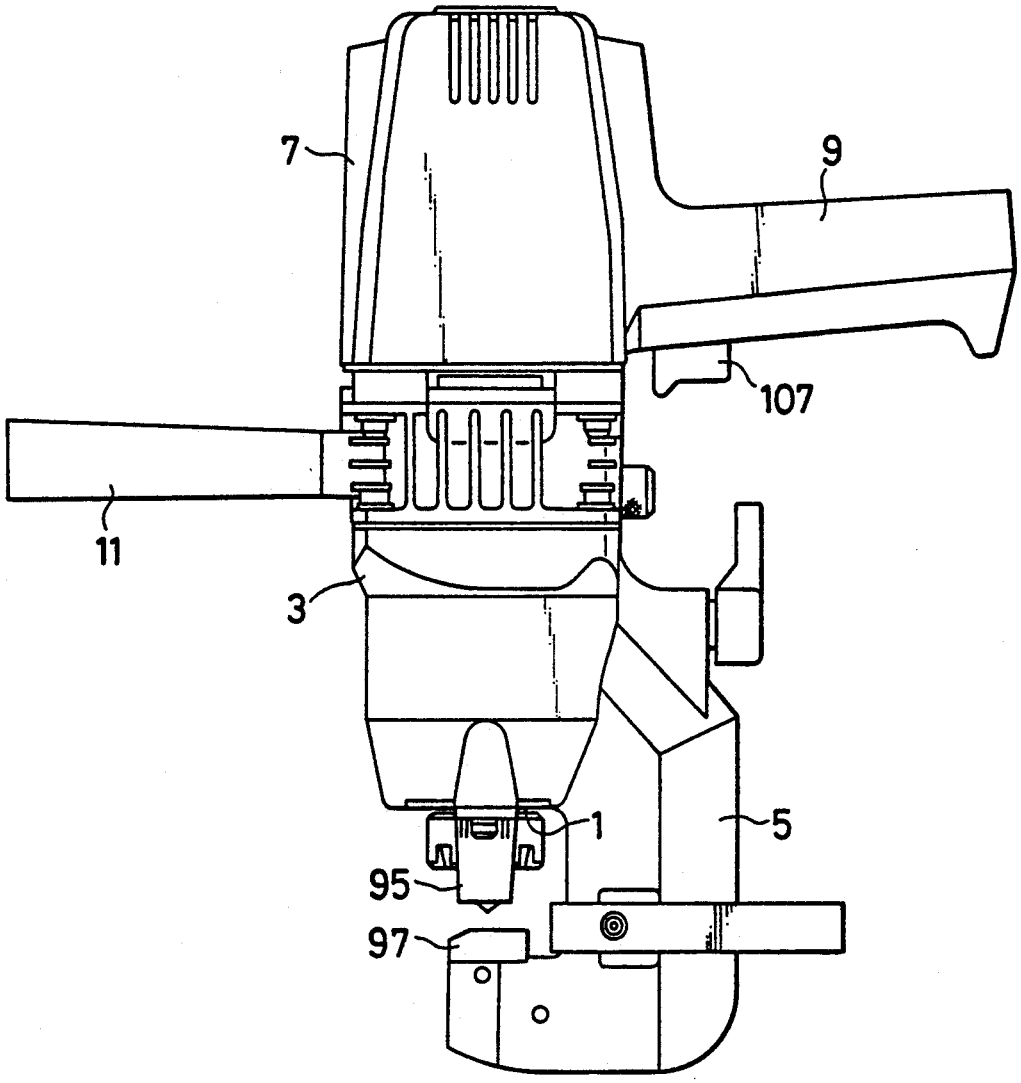
FIG. 2 is a front view of the hydraulic puncher as shown in FIG. 1.

Referring to FIGS. 1 and 2, a hydraulic punch for forming a hole by shearing in a metallic workpiece is preferably of a portable type and comprises a generally cylindrical central casing 3, a U-shaped die arm 5 integrally formed on the front end of the casing 3, an electric motor 7 fixed to the rear end of the casing 3 via an end member 4, a main handle 9 fixed to one lateral side of the casing 3 and a sub-handle 11 fixed to the other lateral side of the casing 3. A piston rod 2 extends outwardly from the front end of the casing 3. The casing 3 has a stepped cylindrical inner peripheral wall 6.

An operating unit 13 is provided in the front half portion of the casing 3, and a pump unit 15 is provided in the rear half portion of the casing 3.

In the operating unit 13, a piston assembly 1 comprises a reciprocating piston 17 and the piston rod 1, coaxially extending from the rear face of the piston 17, and is provided in the casing 3 such that the piston 17 slides on the intermediate portion of the cylindrical inner wall 6 of the casing 3. The piston assembly 1 advances when pressurized operating oil supplied by a pump unit 15 provided in the casing 3 is applied to the rear face of the piston 7, and is retracted, as shown in FIG. 1, by means of a compression coil spring 19 provided between the rear face of the piston 7 and the front inner wall of the casing 3 when the pressurized operating oil is not supplied to the rear end of the piston 7.

The pump housing 21 of the pump unit 15 has a male screw 23 formed on its outer peripheral wall and engaged with a female screw 25 formed on the rear portion of the inner peripheral wall 6 of the casing 3. A cylinder chamber 27 is defined by the front end face 18 of the pump housing 21 and the intermediate portion of the inner cylindrical wall 6 of the casing 3 on which the piston 17 slides. A hermetically sealed first oil reservoir 29 is formed in the rear end portion of the casing 3 and the end member 4.

The structure of the pump unit 15 will hereinafter be described.

An eccentric shaft 33 is rotatably supported by the pump housing 21 via bearings 35 and 37 and is connected to the motor shaft 31 of the electric motor 7. On the eccentric shaft 33 is mounted a cylindrical cam 39 which also comprises a needle bearing.

Pumps 41 are formed in the pump unit 15 and each of the pumps comprises the following:

A plurality of elongated plunger holes 45 are arranged circumferentially in the pump housing 21 and extend radially outward from the cylindrical cam 39. A hollow cylindrical plunger 47 with a blind bottom end is slidably inserted in each plunger hole 45 and urged inward of the pump housing 21 by means of a compression coil spring 49 such that the inner end of the plunger 47 abuts against the outer peripheral surface of the cam 39.

In the outer end portion of each plunger hole 45 is provided a check valve 53 which allows pressurized operating oil to flow from the first oil reservoir 29 into the cylinder chamber 27 through a sucking passage 43 and a pressurized-oil supplying passage 51 formed in the pump housing 21 when the check valve 53 is moved outward of the plunger hole 45 by the biasing force of the compression coil spring 49, as the plunger 47 is displaced toward the outer end of the plunger hole 45 due to the rotation of the eccentric cam 33. The operating oil supplied to the cylinder chamber 27 pushes the piston 17 forward.

Referring again to the operating unit 13, a central hole or a valve receiving chamber 57 extends from the rear end face of the piston 17 and an intermediate portion of the piston rod 2. A holder 59 is mounted in the enlarged front end portion of the central hole 57 and fixed to the piston 17. An oil return valve 55 mounted in the central hole 57 comprises a rod portion 55B and a valve body portion 55A formed on the front end of the rod portion 55B and having a larger diameter than the rod portion 55B. The rod portion 55B passes through the central portion of the holder 59 so as to reciprocate therethrough.

A compression coil spring 61 is wound around the rod portion 55B and is engageable at both ends with the front face of the piston 17 and a stop 63 provided on the rear end portion of the rod portion 55B such that the oil return valve 55 is prevented from slipping off the piston assembly 1. The spring 61 has a smaller free length than the distance between the piston 17 and the stop 63 when the valve body portion 55B abuts against the piston 17.

Between the bottom face of the valve body portion 55A engageable with the inner end face 6 of the pump housing 21 and a depression 64 formed in the central portion of the front end face of the pump housing 21 is provided a relatively weak spring 65. A first oil return passage 67 formed in the pump housing 21 allows the cylinder chamber 27 to communicate with the first oil reservoir 29.

When the pressurized operating oil is supplied from the pumps 41 into the cylinder chamber 27 and the force exerted on the front face of the piston 17 due to the pressure in the cylinder chamber 27 exceeds the biasing force of the compression coil spring 19, the piston 17 is moved in the direction of the arrow A in FIG. 1. Together with the piston 17, the holder 59 is moved in the same direction with the compression coil spring 61 compressed, and the first force directed in the direction of the arrow A is exerted on the oil return valve 55.

On the other hand, the valve body portion 55A of the oil return valve 55 is pressed against the front end face of the valve body 15 by the pressure in the cylinder chamber 27 and closes the first oil return passage 67. In other words, the second force for causing the valve body portion 55A to close the first oil return passage 67, which force is directed in the direction opposite to the first direction shown by the arrow A, is exerted on the oil return valve 55.

As the pressure in the cylinder chamber 27 increases, these opposed forces also increase. In this state, the second force is larger than the first force and thus the first oil return passage 67 remains closed. When, however, a boss portion 56 extending from the rear face of the holder 59 toward the stop 63 abuts against the stop 63, the driving force of the piston 17 in the direction of the arrow A is directly applied to the oil return valve 55 and thus the first force exceeds the second force. The oil return valve 55 is moved in the direction of the arrow A to disengage the valve body portion 55A from the inner end face 18 of the pump housing 15. The first oil return passage 67 is opened and the operating oil flows from the cylinder chamber 27 into the first oil reservoir 29 through the first oil return passage 67. As the operating oil returns, the pressure in the cylinder chamber 27 decreases such that the piston 17, which has returned to the initial position due to the biasing force of the compression coil spring 19 and the valve body portion 55A, closes the first oil return passage 67.

Figure 3:
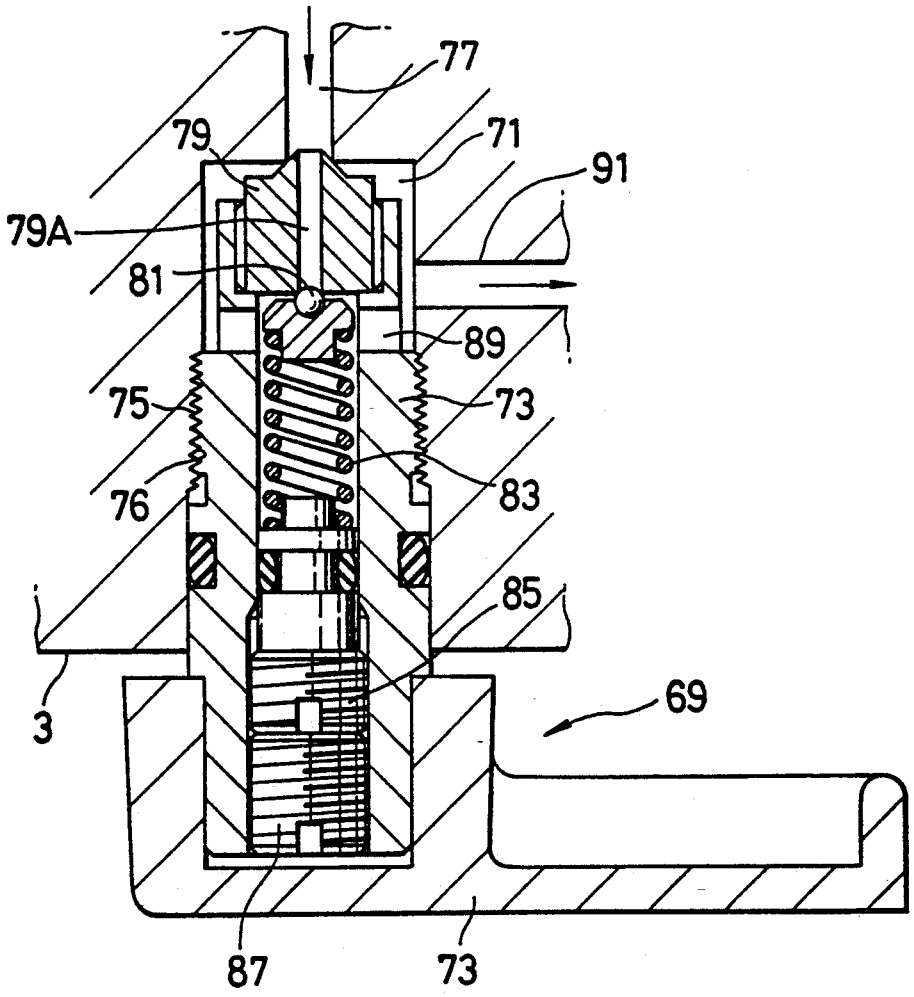
FIG. 3 is a longitudinal cross-sectional view of a return-relief valve provided in the hydraulic puncher as shown in FIG. 1.

As shown in FIGS. 1 and 3, an oil return valve 69 is provided in a cylindrical valve chamber 71 radially extending from the outer peripheral surface of the casing 3 toward the axis thereof terminated at the outer edge of the front end face of the pump housing 21. A hollow cylindrical valve housing 73 is fitted into the valve chamber 71 by threadably engaging a male screw 75 formed on the outer peripheral wall of the valve housing 73 with a female screw 76 formed on the inner peripheral wall of the valve chamber 71. The axial movement of the valve housing 73 is adjusted by the rotation of an operating lever 93 fixed to the outer end of the valve housing 73. The valve chamber 71 is connected at its inner end to the cylinder chamber 27 via a valve hole 77 formed in the casing 3. A valve body 79 is fixed to the inner end of the valve housing 73 and normally closes the hole 77. The valve body 79 has a central hole 79A which communicates with the hole 77 and is normally closed by a ball 81 under the biasing force of a compression coil spring 83. Adjusting the meshing depth of an adjusting screw 85 and a locking screw 87 screwed into the valve housing 73 allows proper selection of the biasing force of the compression coil spring 83. In the portions of the valve housing 73 which are close to the ball 81 are formed radial holes 89 which communicate with the cylinder chamber 27 through the holes 79A and 77 when the ball 81 is disengaged from the central hole 79A. The radial holes 89 communicate with the first oil reservoir 29 through a second oil return passage 91 formed in the valve housing 21.

The oil return valve 69 not only functions as a safety valve but also functions as a release valve.

When the pressure in the cylinder chamber 27 tends to rise abnormally beyond the allowable pressure, the ball 81 is pushed by the elevated pressure to open the central hole 79A, thereby causing the cylinder chamber 27 to communicate with the second oil return passage 91. In this way, the abnormally high pressure escapes from the cylinder chamber 27 to the first oil reservoir 29. Namely, the cylinder chamber 27 is prevented from being subjected to an abnormally high pressure. This is the safety valve function of the oil return valve 69.

In order to lower the pressure in the cylinder chamber 27 forcibly, the operating lever 93 is rotated in the direction in which the valve housing 73 is moved axially and outward. The inner end of the valve body 79 is separated from the valve hole 77 such that the cylinder chamber 27 communicates with the first oil reservoir 29 through the second oil return passage 91. This is the release valve function of the oil return valve 69. This release valve function is used when the piston 17 must be returned rapidly to its original position after the motor 7 has been started.

As shown in FIGS. 1 and 2, the hydraulic puncher is provided with a hole shear-forming tool. For example, a punch 95 is provided on the front end 2A of the piston rod 1 and a die 97 in which the punch 95 can be inserted is provided on the die arm 5. As shown in FIG. 1, in the die arm 5 is formed a second oil reservoir 99 communicating with the first oil reservoir 29 and the first oil reservoir 29. Especially, a flexible air bag 103 made of a flexible plastic material or the like is placed in an elongated reservoir hole 101 and the open end of the air bag 103 is fixed to the front end portion of the die arm 5 by means of a stop 105 having a through hole 105A and the second reservoir 99 is defined between the inner walls of the reservoir hole 101 and the outer surface of the air bag 103. The reservoir hole 101, the second reservoir 99, the air bag 103 and the stop 105 constitute an oil volume adjuster 100.

Operating oil is filled in the cylinder chamber 27, the first oil reservoir 29 and the second oil reservoir 99 such that the operating oil is hermetically sealed in them. The air bag 103 is pressed and deformed by the pressure of the operating oil. As the operating oil is supplied to the cylinder chamber 27 under pressure and as the operating oil is returned to the first reservoir 29, the volume of the operating oil in the second oil reservoir 99 alternately increases and decreases, and the air bag 103 is alternately inflated and shrunk according to the decrease and increase of the volume of the operating oil in the second oil reservoir 99, whereby air is prevented from entering the first oil reservoir 29, etc.

The operation of the hydraulic puncher according to this embodiment will be described.

The motor 7 is operated by turning on a switch 107 provided on the casing 3 (FIG. 1) and the eccentric shaft 33 is rotated. The plunger 47 circumferentially arranged and extending radially from the eccentric shaft 33 reciprocate in the plunger holes 45 and supply operating oil under pressure from the first oil reservoir 29 to the cylinder chamber 27. The operating oil supplied into the cylinder chamber 27 advances the piston 17, and the punch 95 fixed to the front end of the piston rod 1 approaches the die 97. A workpiece disposed between the punch 95 and the die 97 is formed with a hole by shearing. During the advance of the piston 17, the first oil return passage 67 is closed by the valve body portion 55A of the oil return valve 55, and the second oil return passage 91 is closed by the oil return valve 69, whereby the piston 17 is moved forward effectively by the operating oil supplied by the pumps 41 into the cylinder chamber 27 under pressure.

When the piston 17 advances to the position at which hole forming in a work piece is completed by means of the punch 95 and the die 97, the boss portion 56 of the holder 59 abuts against the stop 63. The oil return valve 55 is pushed in the direction of the arrow A and the valve body portion 55A is separated from the first oil return passage 67, whereby the operating oil is caused to flow from the cylinder chamber 27 into the first oil reservoir 27 through the first oil return passage 67. Since the valve body portion 55A is separated largely from the first oil return passage 67, the operating oil flows quickly from the cylinder chamber 27 to the first oil reservoir 27 until the pressures in the cylinder chamber 27 and the first oil reservoir 29 are rendered equal. When the piston 17 advances to the position at which the hole shearforming is completed, the switch 107 is normally turned off.

As the pressure in the cylinder chamber 27 is reduced due to the return of the operating oil to the first oil reservoir 29, the piston 17 is retracted by the biasing force of the compression coil spring 19. When the piston 17 is fully retracted, the valve body portion 55A closes the first oil return passage 67 and returns the piston assembly 1 to the initial state.

When the punch 95 hits against an obstruct or a workpiece which is too hard to be cut and is prevented from advancing while the pump 41 is driven by means of the electric motor 7, the pressure in the cylinder chamber 27 is elevated to a predetermined value. The ball 81 of the oil return valve 69 is separated from the central hole 79A of the valve body 79 and the pressurized operating oil flows from the cylinder chamber 27 into the first oil reservoir 29 through the second oil return passage 91 such that the pressure in the cylinder chamber 27 is lowered.

On the other hand, when it is required that the piston 17 be returned to the original position quickly soon after the advance of the piston 17 has started, the valve housing 73 is moved radially outward of the casing 3 by rotating the operating lever 93, and thus the valve body 79 is separated from the valve hole 77, such that the cylinder chamber 27 communicates with the first oil reservoir 29 through the second oil return passage 91. In this way, the oil return valve 69 functions as a relief valve which quickly stops the advance of the piston 17.

The hydraulic actuator according to this invention comprises a casing, a pump unit inserted in the casing and threadably fixed to the casing by engaging a male screw formed on the outer peripheral wall of the pump unit with a female screw formed on the inner peripheral wall of the casing, a cylinder chamber defined by the inner peripheral wall of the casing and the inner end of the pump unit, and a piston reciprocatingly provided in the cylinder chamber. In this structure, the withstanding pressure of the cylinder chamber depends on the mechanical strength of the casing, not on the mechanical strength of bolts used for tightening the flanges of the prior art flange type hydraulic actuator. In this respect, the hydraulic actuator according to this invention readily withstands a higher pressure than the flange type hydraulic actuator does. Further, since the hydraulic actuator according to this invention employs fewer bolts than the flange type hydraulic actuator, manufacturing and assembling costs are reduced and unsatisfactory assembly due to the tightening of the bolts with uneven torques or incomplete tightening of the bolts is avoided, thus increasing productivity of this invention. In addition, the provision of an oil return valve and a relief valve in the casing further enhances safety.

In particular, since the hydraulic actuator according to this invention has a unit structure comprising a motor unit, a pump unit and an operating unit, hydraulic actuators having various operational specifications for driving forces, usages, etc. can be easily manufactured by selecting and assembling these units so as to be suitable for these operational specifications.

This invention is not limited to the above-mentioned embodiment but is applicable to various modifications which fall within the scope of this invention. For example, this invention is applicable to a hydraulic actuator using a linearly shearing cutter, a bending tool, a caulking tool or the like.

What is claimed is:

1. A hydraulic actuator comprising:

a casing having an inner peripheral wall formed with a female screw;

a pump unit fixedly fitted in said casing and having an inner end face, said pump unit including a pump housing having an outer surface formed with a male screw threadedly engaged with said female screw in such a way that said pump housing is fixedly held in said casing;

a cylindrical chamber defined by said inner peripheral wall of said casing and said inner end face of said pump unit;

a reciprocating piston assembly provided in said cylinder chamber and having an end provided with a tool;

an oil reservoir filled with operating oil and provided adjacent to said pump unit; and said pump unit sucking said operating oil from said oil reservoir and supplying said operating oil to said cylinder chamber.

2. The hydraulic actuator according to claim 1, wherein said casing has formed therein an oil return passage for connecting said cylinder chamber to said oil reservoir, and is provided with a valve for normally closing said oil return passage and opening said oil return passage when a pressure in said cylinder chamber exceeds a predetermined pressure for selectively closing and opening said oil return passage.

3. The hydraulic actuator according to claim 2, wherein said valve has an operating lever for moving said valve toward and away from said oil return passage.

4. The hydraulic actuator according to claim 2, wherein said valve comprises a valve chamber formed in said casing, a valve housing slidably inserted in said valve chamber and having two ends, a valve body connected to one of said two ends of said valve housing and having a central hole communicating with said cylinder chamber and said oil return passage, opening and closing means for closing said central hole of said valve body against a pressure in said cylinder chamber when said pressure is lower than a predetermined value and opening said central hole when said pressure in said cylinder chamber exceeds said predetermined value.

5. The hydraulic actuator according to claim 4, wherein said opening and closing means comprises a ball abuttable against said central hole and a spring for biasing said ball toward said central hole.

6. The hydraulic actuator according to claim 4, wherein said valve chamber has a female screw and said valve housing has an male screw rotatably engaging with said female screw of said valve chamber.

7. The hydraulic operator according to claim 6, wherein said valve has an operating lever fixed to the other end of said valve housing, for moving said valve toward and away from said oil return passage.

8. The hydraulic actuator according to claim 1, wherein said tool comprises a linearly shearing cutter.

9. The hydraulic actuator according to claim 1, which is of a portable type.

* * * * *